US010408444B2

(12) United States Patent
O'Brien et al.

(10) Patent No.: US 10,408,444 B2
(45) **Date of Patent: *Sep. 10, 2019**

(54) RECESSED LED LIGHT FIXTURE WITHOUT SECONDARY HEAT SINK

(71) Applicant: CORDELIA LIGHTING INC., Rancho Dominguez, CA (US)

(72) Inventors: Aaron O'Brien, Los Alamitos, CA (US); Seth Chang, Rowland Heights, CA (US); Huan C. Nguyen, Anaheim, CA (US)

(73) Assignee: CORDELIA LIGHTING INC., Rancho Dominguez, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/103,758

(22) Filed: Aug. 14, 2018

(65) Prior Publication Data

US 2018/0347801 A1 Dec. 6, 2018

Related U.S. Application Data

(63) Continuation of application No. 14/594,080, filed on Jan. 10, 2015, now Pat. No. 10,047,944.

(Continued)

(51) Int. Cl.

| | |
|---|---|
| ***F21V 29/70*** | (2015.01) |
| ***F21V 29/89*** | (2015.01) |
| ***F21V 23/00*** | (2015.01) |
| ***F21V 7/04*** | (2006.01) |
| ***F21V 13/04*** | (2006.01) |

(Continued)

(52) U.S. Cl.

CPC ..... *F21V 29/70* (2015.01); *F21K 9/20* (2016.08); *F21S 8/026* (2013.01); *F21V 7/04* (2013.01); *F21V 13/04* (2013.01); *F21V 17/16* (2013.01); *F21V 21/04* (2013.01); *F21V 23/009* (2013.01); *F21V 23/0435* (2013.01); *F21V 29/89* (2015.01); *F21V 33/0052* (2013.01); *H05B 33/0803* (2013.01); *F21Y 2115/10* (2016.08)

(58) Field of Classification Search

None

See application file for complete search history.

(56) References Cited

U.S. PATENT DOCUMENTS

| | | |
|---|---|---|
| 7,722,227 B2 | 5/2010 | Zhang et al. |
| 8,403,531 B2 | 3/2013 | Negley et al. |

(Continued)

OTHER PUBLICATIONS

CA, 2,880,397 Examiner's Report, dated Dec. 2, 2016.

CA, 2,880,397 Amendment/Remarks After Examiner's Report, dated Jun. 2, 2017.

*Primary Examiner* — Elmito Breval

(74) *Attorney, Agent, or Firm* — Paul Y. Feng; One LLP

(57) ABSTRACT

A recessed LED light fixture without need for a bulky, finned, metal heat sink. The recessed LED light fixture includes a Metal Core Printed Circuit Board (MCPCB) holding an array of LEDs that are arrange at the center thereof, and mounted to the printed circuit board using patterns of electrical and greases used to conduct a current and radiate heat. A mounting bracket holds the entire assembly for the light fixture together while spacing the LED driver and printed circuit board apart for further cooling, and wherein the upper side of the printed circuit board is exposed to the ambient air inside the housing.

20 Claims, 21 Drawing Sheets

Related U.S. Application Data

(60) Provisional application No. 61/926,234, filed on Jan. 10, 2014.

(51) Int. Cl.

| | |
|---|---|
| ***F21S 8/02*** | (2006.01) |
| ***H05B 33/08*** | (2006.01) |
| ***F21V 33/00*** | (2006.01) |
| ***F21V 17/16*** | (2006.01) |
| ***F21V 21/04*** | (2006.01) |
| ***F21V 23/04*** | (2006.01) |
| ***F21K 9/20*** | (2016.01) |
| *F21Y 115/10* | (2016.01) |

(56) References Cited

U.S. PATENT DOCUMENTS

| | | | | |
|---|---|---|---|---|
| 8,454,204 | B1 | 6/2013 | Chang et al. | |
| 8,511,851 | B2 | 8/2013 | Van de Ven et al. | |
| 8,926,145 | B2 * | 1/2015 | Lynch | F21S 8/02 257/98 |
| 2008/0112168 | A1 | 5/2008 | Pickard et al. | |
| 2009/0080189 | A1 | 3/2009 | Wegner | |
| 2009/0196016 | A1 | 8/2009 | Massara et al. | |
| 2010/0237781 | A1 | 9/2010 | Dupre et al. | |
| 2011/0075411 | A1 | 3/2011 | Van de Ven et al. | |
| 2011/0075414 | A1 | 3/2011 | Van de Ven et al. | |
| 2011/0075422 | A1 | 3/2011 | Van de Ven et al. | |
| 2011/0075423 | A1 | 3/2011 | Van de Ven | |
| 2011/0080727 | A1 | 4/2011 | Maxik et al. | |
| 2012/0182744 | A1 | 7/2012 | Santiago et al. | |
| 2013/0016509 | A1 | 1/2013 | Van de Ven | |
| 2013/0100658 | A1 | 4/2013 | Pickard et al. | |
| 2014/0049957 | A1 | 2/2014 | Goelz et al. | |

* cited by examiner

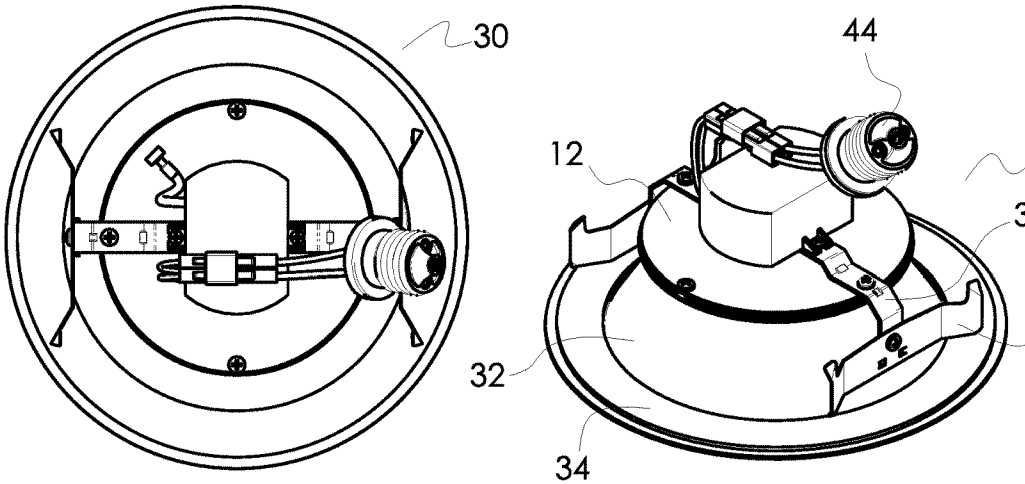
FIG.1(a)
FIG.1(b)
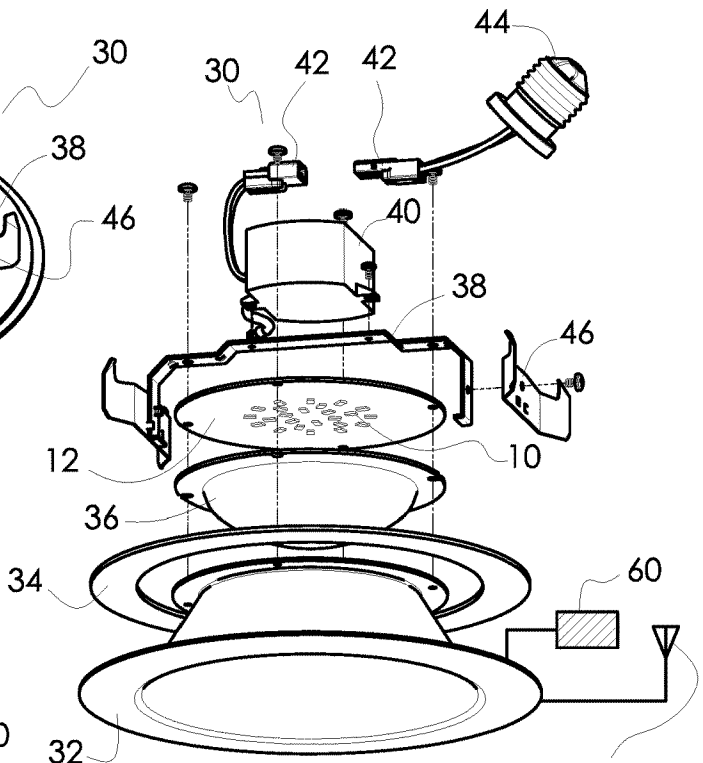
FIG.1(c)
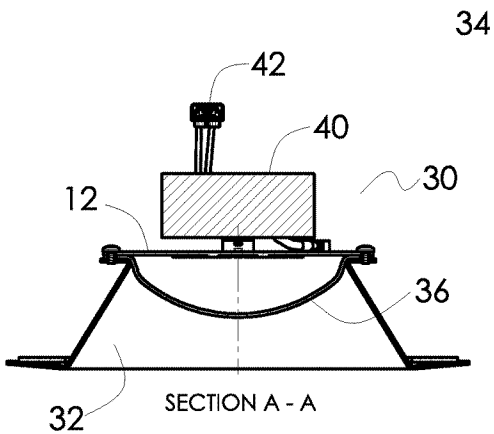
FIG.1(e)
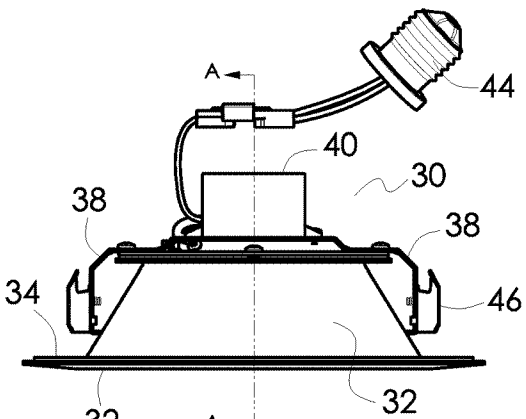
FIG.1(d)

SECTION B - B

SECTION D-D

RECESSED LED LIGHT FIXTURE WITHOUT SECONDARY HEAT SINK

CROSS-REFERENCE TO RELATED APPLICATIONS

This application is a continuation of U.S. patent application Ser. No. 14/594,080, filed Jan. 10, 2015, which claims priority to U.S. provisional patent application No. 61/926,234, filed Jan. 10, 2014, the contents of all of which are incorporated herein by reference.

FIELD OF THE INVENTION

The present invention relates to recessed lighting fixtures. In particular, the present invention relates to an LED recessed light fixture.

BACKGROUND OF THE INVENTION

Recessed lighting fixtures are well known in the art. Ideally, such fixtures are designed to be visually unobtrusive in that very little of the lighting fixture is visible from below the ceiling. However, some trim portions are visible as well as the light sources. An opening is cut into the ceiling into which most of the lighting fixture is mounted so that very little extends below the plane of the ceiling. The recessed light fixture is typically contained in a metal housing, can, pan, or enclosure mounted above the ceiling plane. A trim piece or trim ring, which may take the form of a bezel, is generally located at the opening to enhance the appearance of the light fixture and conceal the hole cut into the ceiling. Typically, the trim piece is slightly below the planar surface of the ceiling.

Such bezels or other types of trim pieces often include insulation or a gasket located between the trim piece and the ceiling. In many cases, recessed lighting fixtures are installed in holes in ceilings where the temperature is much different from that of the room into which the light fixture provides illumination. The insulation tends to block the thermal gradient that changes the room temperature due to the hole cut in the ceiling for the lighting fixture.

Although described in a ceiling embodiment, such lighting fixtures are also used in walls in both dwelling structures and even in automobiles, in numerous commercial office buildings and big box retailers, and in many other applications like an RV, custom homes, etc. Such lighting fixtures are generally referred to herein as "recessed."

SUMMARY OF THE INVENTION

The present invention in various preferred embodiments is directed to an LED light fixture for installation to a building framework, comprising a plurality of LEDs, a printed circuit board preferably a Metal Core Printed Circuit Board (MCPCB), wherein the LEDs are mounted toward the center of the printed circuit board, and the LEDs are connected by paths of electrical and thermal conductor material. The printed circuit board has an annular surface area around the outer periphery or edge optionally containing the electrical and thermal conductor material and no LEDs. The fixture includes a reflector trim having an open top, wherein the printed circuit board is mounted to the open top and part of the annular surface area coupled to or in close proximity to the reflector trim, wherein the reflector trim includes a material with a thermal conductivity of 2 W/m-K through 49 W/m-K inclusive, and includes a minimum reflectivity of 20%. The reflector trim includes an annular flange around the open top to engage the printed circuit board at the annular surface area. The printed circuit board may have an oversized outside diameter so that it overhangs the top of the reflector trim. The fixture further includes an LED driver for powering the LEDs, a mounting system spacing the LED driver away from the printed circuit board creating a gap therebetween, and attachment means for mounting the light fixture to an enclosure, can, pan, or building framework.

BRIEF DESCRIPTION OF THE DRAWINGS

FIGS. 1(*a*)-1(*e*) show a first embodiment of the present invention recessed LED light fixture, including a top plan view, a perspective view, a side elevational view, a cross-sectional view A-A, and an exploded view. This embodiment includes a quick connect terminal adapted to connect to an optional Edison screw plug. Friction blades are mounted to opposite sides of the driver mounting bracket and used to install the light fixture inside a can, housing, or like enclosure.

FIG. 12 shows a top plan view, a perspective view, a cross-sectional view, and a side elevational view.

FIG. 13 shows a top plan view, a side elevational view, a bottom view, and a cross-sectional view.

FIG. 14 shows a side elevational view, a top plan view, another side elevational view, and a bottom view.

FIG. 16 specifically contains a front elevational view, a side elevational, and a perspective view.

FIG. 17 specifically contains front, top, left side, bottom, and right side views.

DETAILED DESCRIPTION OF THE PREFERRED EMBODIMENTS

As is known in the art, heat is the number one enemy of the LED as it reduces operating life of the LED, diminishes lumens output, wastes energy in that the energy consumed is not efficiently converted to visible light due to heat buildup. Indeed, thermal mitigation is a primary concern to maintain LED lifetime duty ratings and maintain the stated lumens output. Thermal mitigation becomes even more important when the LED assembly is mounted in an enclosed fixture, space, or housing. Exacerbating the heat buildup scenario, if that assembly is located in a ceiling plenum, the ambient temperatures can become elevated further dropping the temperature gradient between the LED assembly and the ambient air.

With further advancements in LED technology, power density is now spread across multiple LED emitters, reducing the need for bulky heat sinks made to handle high density power requirements. Heat sink size has dropped, and often is the same element used as the housing for the LED assembly. Conventional LED heat sinks can range from spun metal cylinders to die cast aluminum truncated cone structures with radial cooling fins. In conventional LED light fixtures, these types of bulky, metal, finned heat sinks are needed to cool the printed circuit board used for mounting the LEDs and sometimes the LED driver.

The printed circuit board (PCB) is the first conductive element with which the hot LEDs come in contact. With the present invention preferred embodiments shown in the attached drawing figures, the printed circuit board is now the primary thermal conductive element needed inside a recessed housing or enclosure—a secondary heat sink with its bulk, fins, and weight, is unnecessary.

Figure 14:
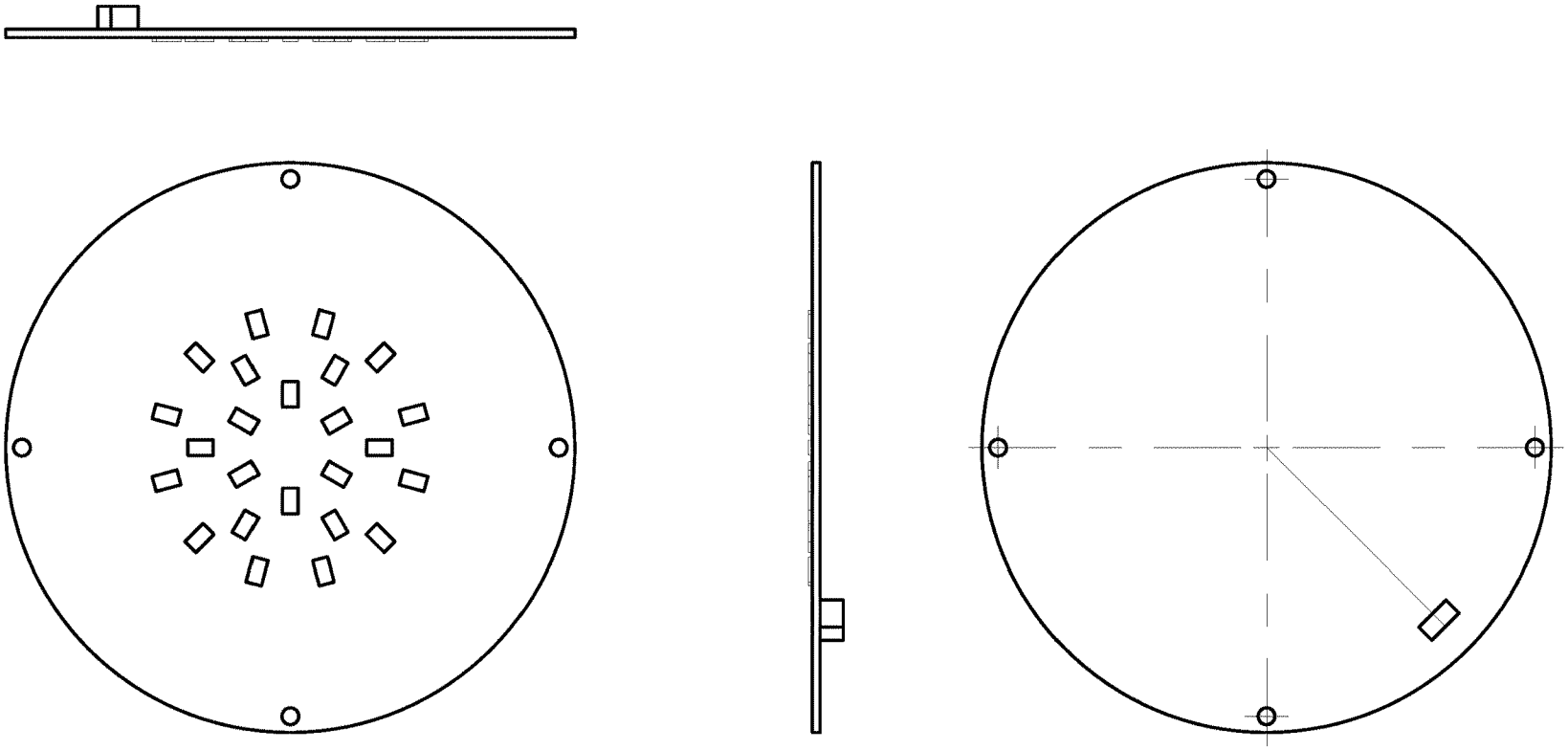
FIG. 14 contains several views of the printed circuit board used in the FIGS. 10 and 11 embodiments, including an array of LEDs arranged according to the present invention.
Figure 15:
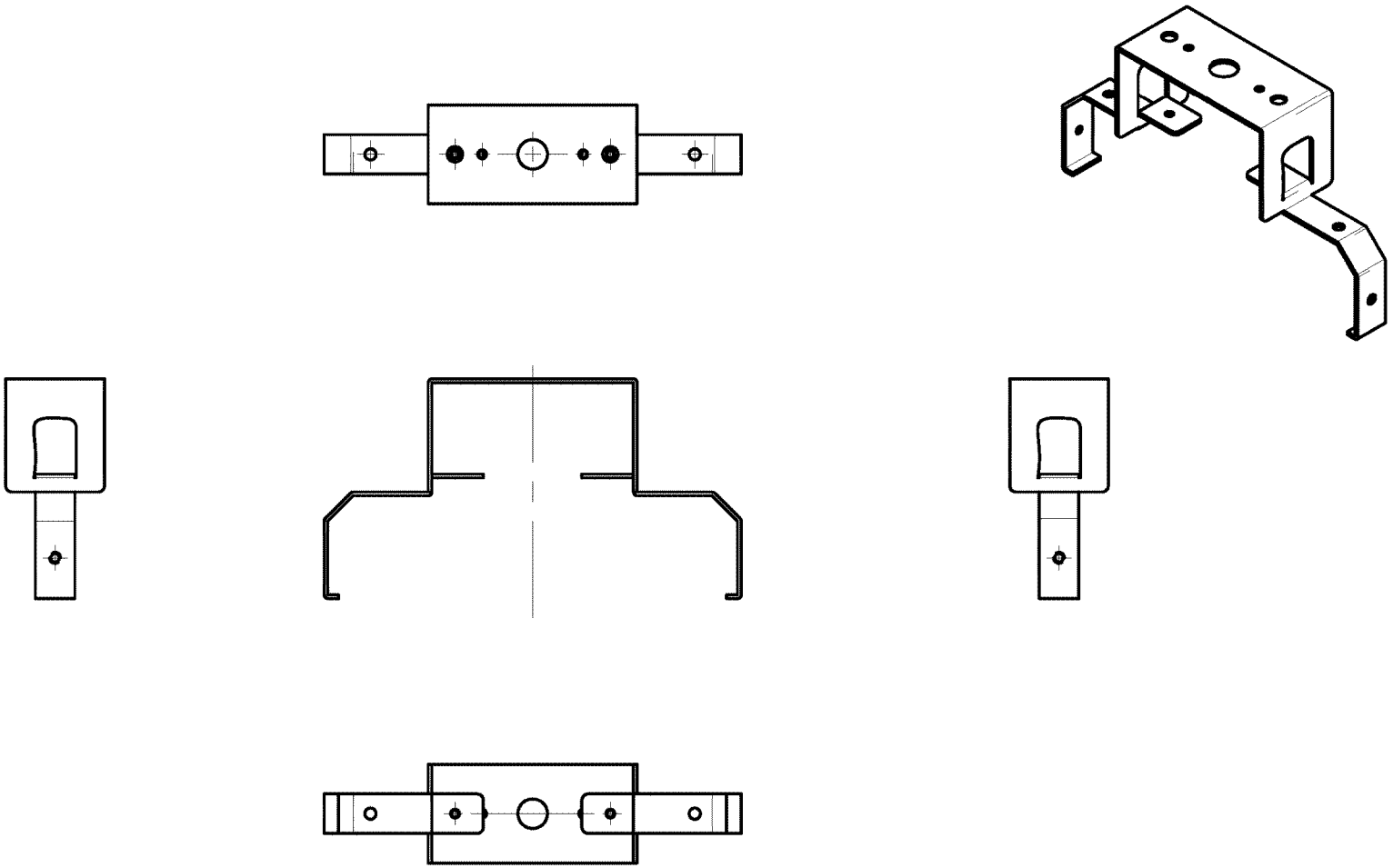
FIG. 15 includes several views of the LED driver mounting bracket used on the FIGS. 10 and 11 embodiments. Specifically, FIG. 15 contains top, bottom, left side, right side, and front views, with a perspective view of the bracket.
Figure 16:
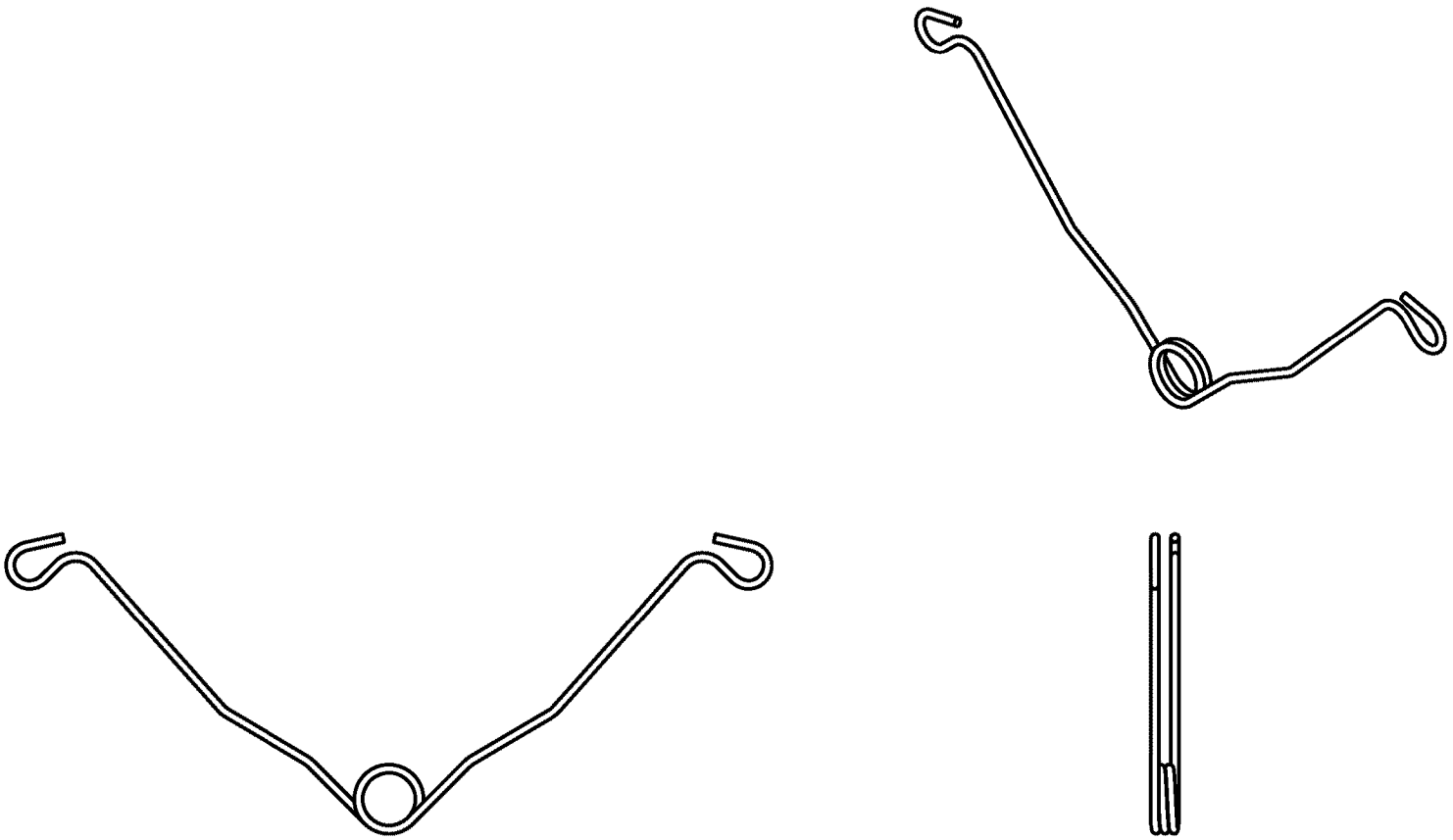
FIG. 16 includes several views of the V-torsion spring clip.
Figure 17:
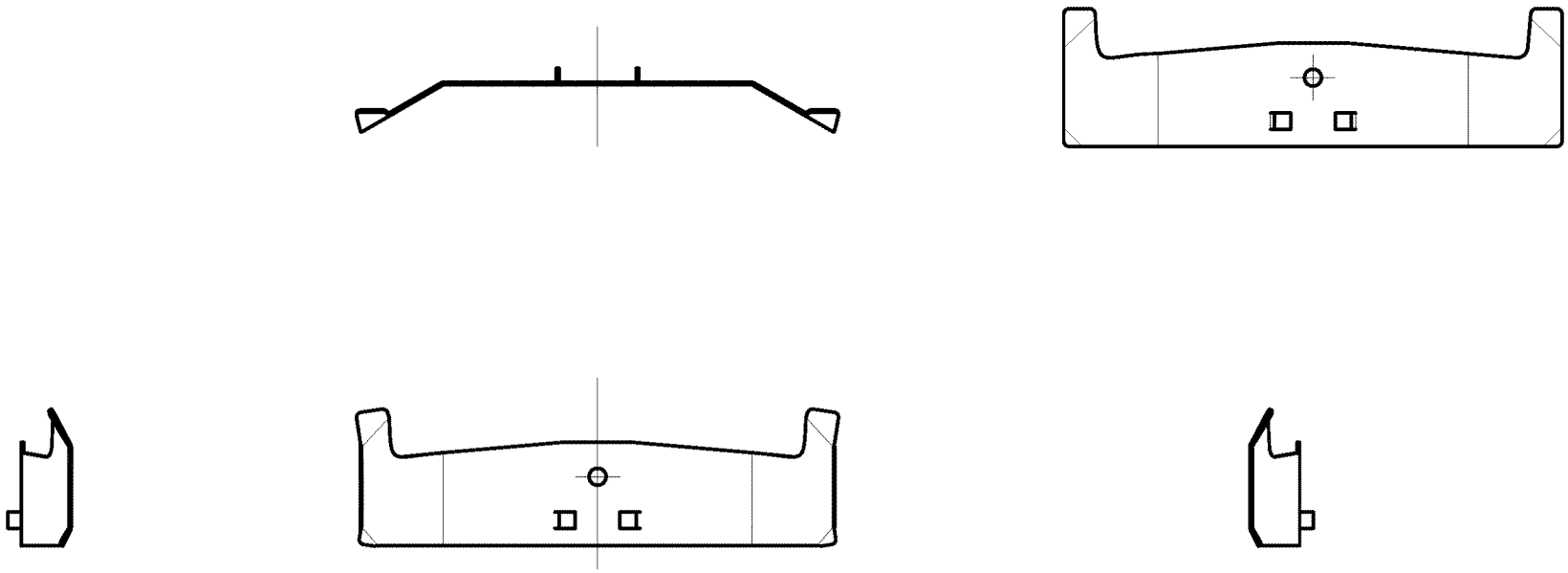
FIG. 17 includes several views of the friction blade.
Figure 18:
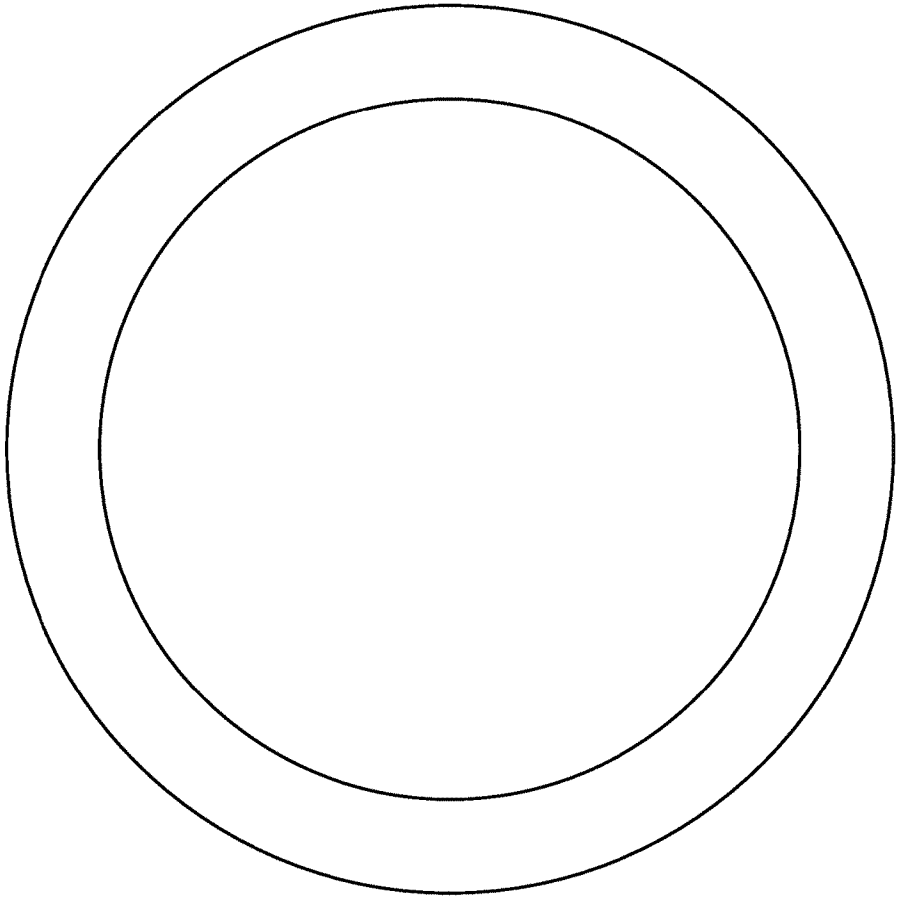
FIG. 18 includes two views of a gasket, including a top view and a side edge view.

As seen in drawing FIGS. 5 and 14, spreading the LEDs 10 across the printed circuit board 12 provides an electrical and/or thermal path for the LEDs 10. The printed circuit board 12 provides a path for heat transfer from the LED 10 to the ambient air surrounding the printed circuit board 12. Specifically, by enlarging the LEDs 10 and clustering the LEDs 10 generally toward the center 14 of the PCB 12, the heat will naturally flow to the outer edges 16 of the PCB 12, both on the unfinished side (FIG. 5(*d*)) of the board 12 and on the printed side (FIG. 5(*b*)) of the board 12. Using multiple LEDs 10 in close proximity in a cluster near the center 14 of the PCB 12 creates a temperature differential of approximately 5 degrees Celsius between the LEDs in the center and the LEDs at the edge of the LED array, shown in FIG. 5(*b*). This is based on empirical observations of recessed LED lighting fixtures in sizes and wattages typically intended for residential or home use.

To further improve cooling, optionally placing each LED 10 on the printed circuit board 12 with its own section of copper or like electrical conductor material that extends from the LED to the outer perimeter of the PCB 12 further helps to reduce the temperature differential between the center LEDs and the LEDs at the perimeter or outer circumference of the LED array. A preferred embodiment of this arrangement is depicted in drawing FIG. 19, where the electrical conductor paths or leads appear as straight, radial paths at the periphery of the PCB 12 and serpentine paths interconnecting the LEDs 10 within the LED array.

Figure 19:
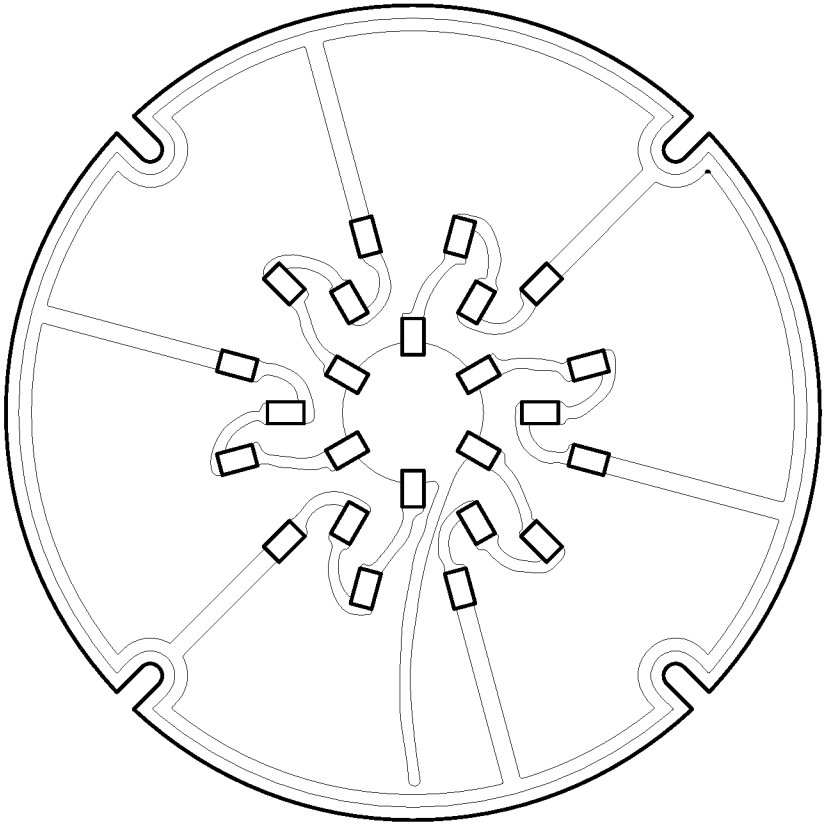
FIG. 19 is a plan view of a preferred embodiment printed circuit board (PCB) showing an arrangement of LEDs positioned on the PCB with copper electrical conductor paths and pie-slice-shaped copper sections for heat dissipation.

In particular, FIG. 19 is a schematic, top plan view of the LEDs, copper or like electrical conductor leads, and copper or like electrical conductor sections arranged on the PCB shown in drawing FIGS. 5 and 14. On the PCB, the small rectangles represent LEDs 10 that are located on narrow paths made of copper, and these paths provide the electrical conduction to power the LEDs. The narrow copper electrical conductor paths are insulated from one another; there are also large, pie slice sections made from copper and they serve as the thermal conductors to radiate heat off the PCB. It is preferable that the copper electrical conductor paths are separate/discrete/insulated from the thermal paths. Some LEDs do not have an isolated area under the LED array for thermal conduction, and in those instances, the thermal paths and electrical paths are shared. Other shapes for the serpentine electrical conductor paths and thermal paths and sections are contemplated. For example, the electrical conductor paths may be straight and arranged like spokes on a wheel, and the large thermal sections may be ovals, polygons, semicircles, etc., or any combination thereof.

In sum, if the printed circuit board is maximized for thermal conduction, it may include sections of copper, separated electrically from the other LEDs, for each LED placed on the circuit board. This copper section(s) would be designed to run from the center of the printed circuit board out to the edge of the printed circuit board to carry the thermal energy to the cooler edges of the board where the convective air flow is created. This pattern would be similar to the spread of a peacock's feathers, where they all start at a common center and each feather tapers larger as it extends from the center.

Further, the copper sections supporting each LED may supply electrical current to the LEDs and/or function as thermal dissipation away from the LEDs. The copper sections occupy large open surface areas to help with heat dissipation.

Figures 20A, 20B:
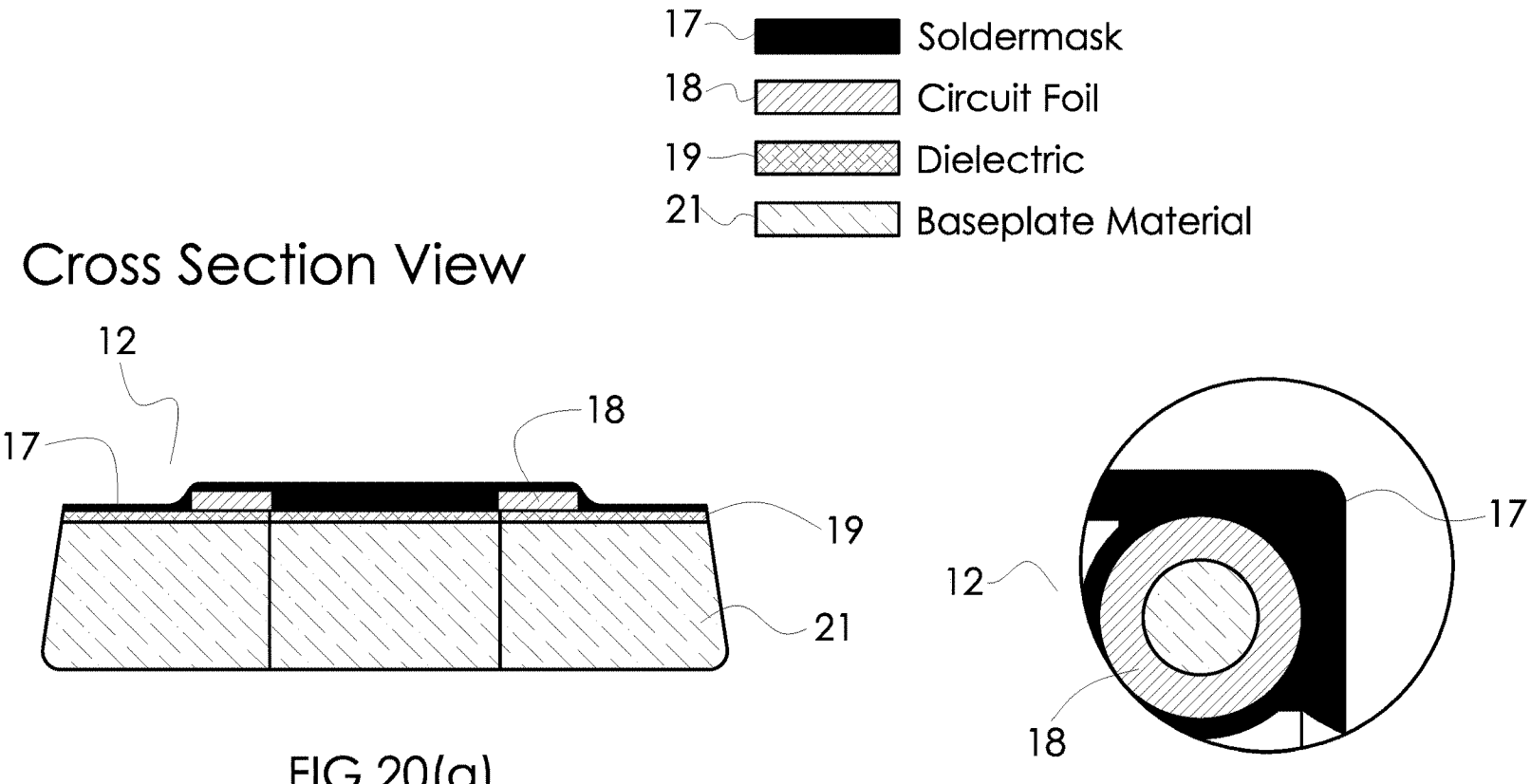
FIGS. 20(*a*) and 20(*b*) are a cross-sectional view and an enlarged top plan view, respectively, of a portion of a PCB showing the different laminated layers of materials.
Figure 21:
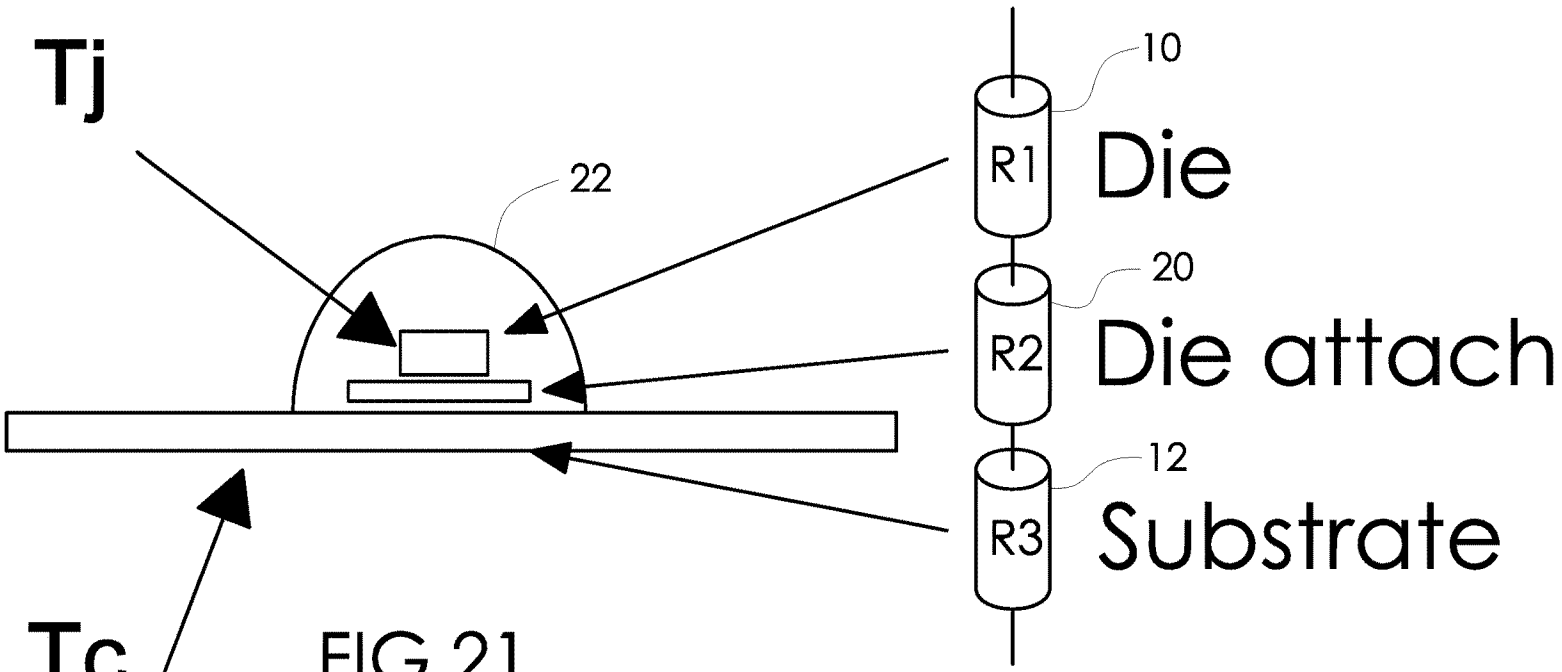
FIG. 21 is a schematic side elevational view and shows the attachment of an LED die to the PCB substrate.

Drawing FIG. 20(*a*) is a side elevational view, in cross-section, of a portion of the preferred embodiment PCB 12. FIG. 20(*b*) is an enlarged, top plan view of the cross-section from FIG. 20(*a*). The PCB 12 is preferably made from a Metal Core Printed Circuit Board (MCPCB), and the copper paths and sections 18 from drawing FIG. 19 are laminated to the dielectric polymer layer 19. The MCPCB is preferably made from a base material 21 such as aluminum, copper, or similar type metal, or any combination thereof. This metallic base 21 material has high thermal conductivity that helps with heat dissipation away from the circuit board 12. In drawing FIG. 20(*a*), a layer 18 labeled "Circuit Foil" in the legend contains the copper paths and sections 12 for electrical conduction and/or heat dissipation. Drawing FIG. 21 is a schematic showing the LED die 10 attached to the MCPCB substrate 12. The LED die 10 is attached to the MCPCB 12 using preferably a layer of thermal conductive paste, adhesive, or solder 20 known in the art. An optional translucent or transparent dome 22 may cover and protect the LED die 10. An optional via is shown in FIG. 20(*a*) to facilitate mounting a LED die. In a preferred embodiment, the primary cooling mechanism is the metal base or core 21 of the MCPCB 12 that radiates and conducts heat away from the LED die 10.

With the PCB arrangement depicted in the top plan view of FIG. 19, thermal dissipation from the PCB is greater in the Z direction (perpendicular, out of the page), top to bottom, than in the x-y direction along the surface of the PCB. The preferred embodiment PCB thus maximizes thermal conduction of heat at the board level by including additional PCB surface area at the periphery extending well past the LED array, and that extended diameter of the PCB helps to conduct heat to the coolest portion of the PCB (i.e., the outer periphery or diameter) and ultimately to the fixture housing. That is, the coolest air within the light fixture enclosure is near the side walls of the housing or can, so directing the heat toward the outer perimeter via a PCB that is larger in diameter promotes convective cooling and increases the surface area for convective heat transfer. When the preferred embodiment PCB is placed into the enclosure, housing, or can, the enclosure allows for convection within itself. When this enclosure has a temperature differential between the top and bottom of the enclosure, convective air flow is possible, and if the enclosure has thermally conductive sides, the heated air that rises is cooled by the thermally conductive walls of the enclosure.

The LED assembly on a PCB can be insulated from making contact with all thermally conductive elements within the recessed enclosure and maintain safe operating temperatures, provided that there is sufficient surface for the printed circuit board and provided that the ambient temperature within the enclosure stays below a predetermined value.

Drawing FIGS. 5, 14 and 19 show preferred embodiment printed circuit boards to which the LEDs are mounted. As described above, the LEDs 10 are arrayed but concentrated at the center of the PCB disk 12, and the PCB disk has a larger surface area than needed to support the LEDs. This enlarged surface area helps with heat dissipation.

Further, the cluster of LEDs 10 are preferably concentrated toward the center and are not mounted at the outer periphery proximate the circumference of the PCB 12, leaving large, open surface areas. The large open surface areas of the PCB are laminated or covered with thermal conductive material known in the art to help radiate and conduct heat as described above. Moreover, the large open areas of the PCB 12 can be mated to the upper lip 48 of the cone-shaped reflector trim 32. Direct contact allows for thermal conduction between the PCB 12 and the reflector trim 32, thus using the mass of the reflector trim 32 for heat dissipation, radiation, and convection into the surrounding environment. Thermal conduction between the reflector trim 32 and the PCB 12 enhances life of the LED, but the reflector trim does not need to be made from traditional, thermally conductive elements such as aluminum or copper. The reflector trim 32 can be made from a material with a thermal conductivity of about 2 W/m-K to about 49 W/m-K, inclusive of the upper and lower limits, and preferably has a minimum light reflectivity coating of about 20% for use in a recessed LED light fixture of a standard size and wattage for residential or commercial use. From empirical observations, such a range ensure proper cooling for long duty life of the LEDs and electrical components. Materials for the reflector trim 32 include thin sheets of steel, iron, or thermally conductive plastic, formed into a cone, with its interior covered by a reflective layer. In an alternative embodiment, the reflector trim 32 can be made from a material with a thermal conductivity as small as about 0.2 W/m-K, found in, for example, low thermal conductivity plastic.

In an alternative embodiment, there is a minimum of about a 3 mm annular gap between the PCB 12 and reflector trim 32, and/or the same annular gap between the diffuser 36 and the reflector trim 32. These gaps enable convective air flow for additional cooling.

Figure 2A:
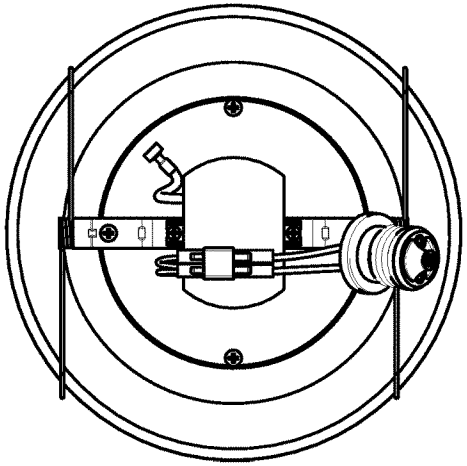
FIGS. 2(*a*)-2(*e*) show a second embodiment, which is the first embodiment light fixture of FIG. 1 but with V-torsion spring clips instead of the friction blades.
Figure 2B:
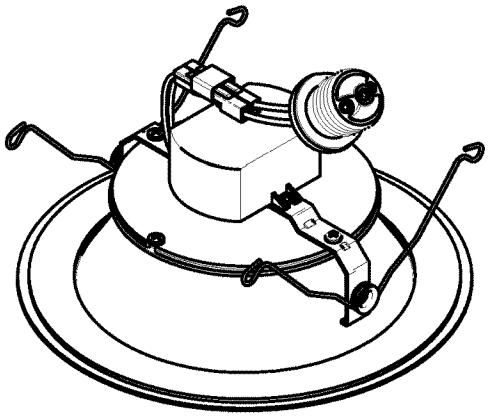
Figure 2C:
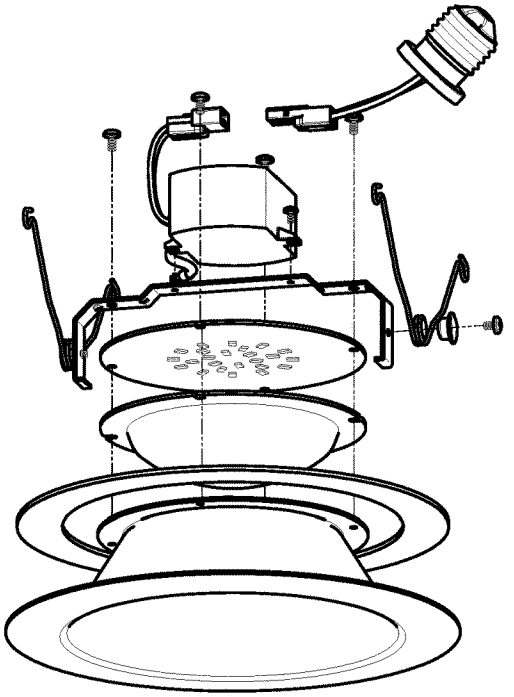
Figure 2D:
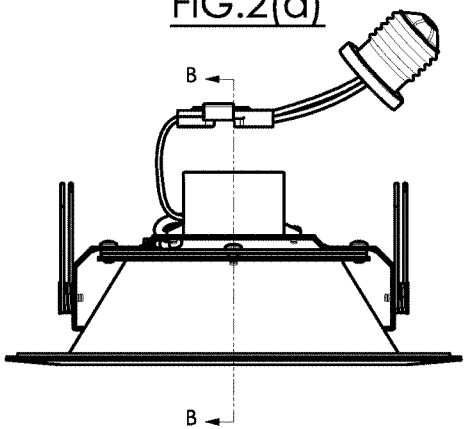
Figure 2E:
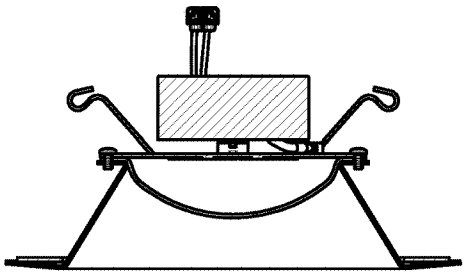
Figure 3A:
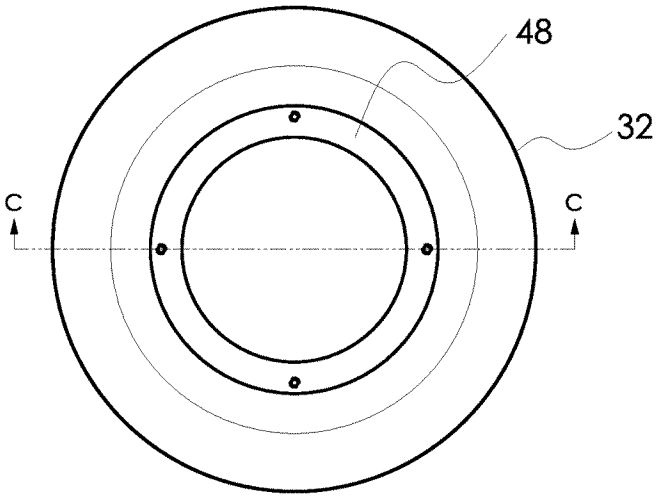
FIGS. 3(*a*)-3(*d*) are several views of the cone-shaped reflector trim used in the light fixtures of FIGS. 1 and 2.
Figure 3B:
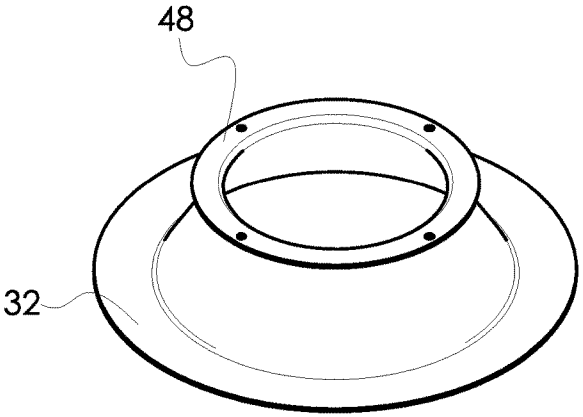
Figure 3C:
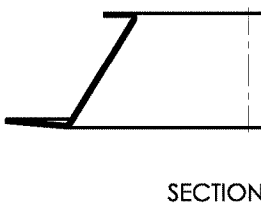
Figure 3D:
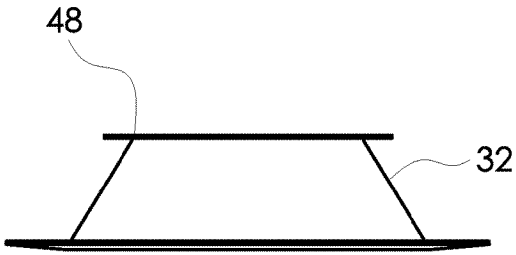
Figure 4C:
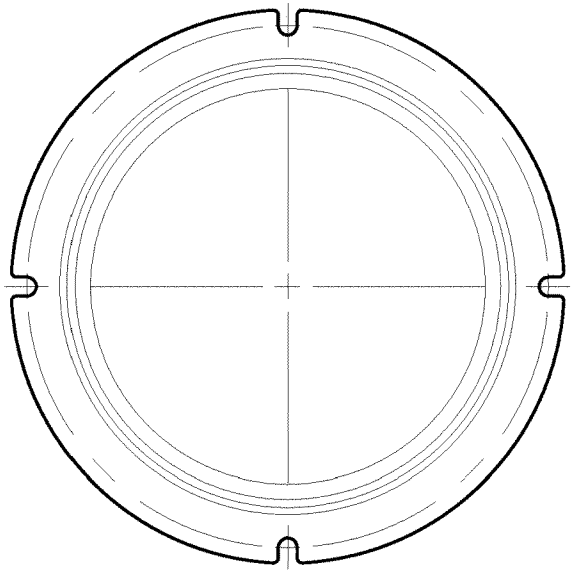
FIGS. 4(*a*)-4(*d*) are several views of the optional domed lens or light diffuser from FIGS. 1 and 2 including a cross-sectional view taken along line D-D. The lens may be transparent, translucent, textured, and/or include surface contours for decoration and for refracting light in a desired pattern.
Figure 4B:
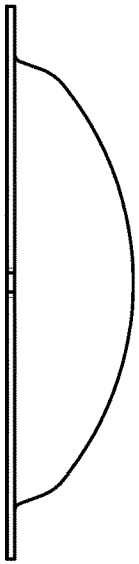
Figure 4A:
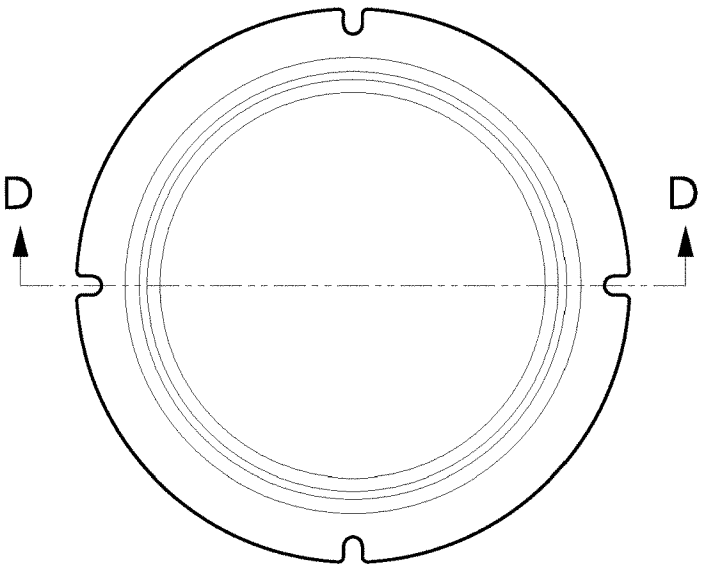
Figure 4D:
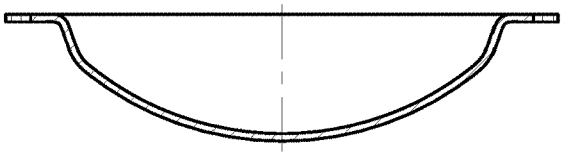
Figure 5A:
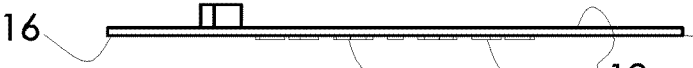
FIGS. 5(*a*)-(*d*) are views of the printed circuit board used in the light fixtures of FIGS. 1 and 2, including an array of LEDs arranged according to a preferred embodiment of the present invention.
Figure 5B:
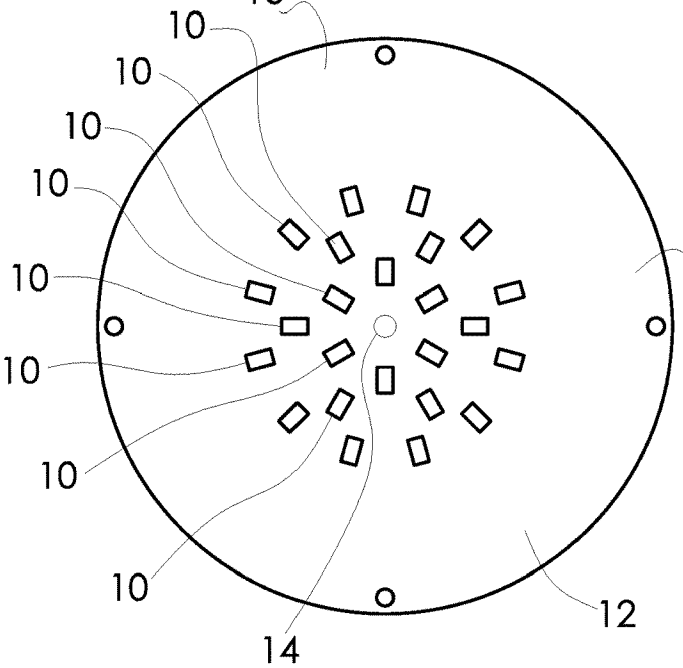
Figure 5C:
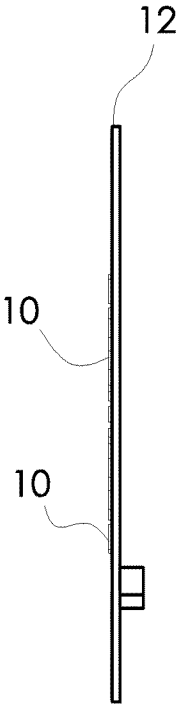
Figure 5D:
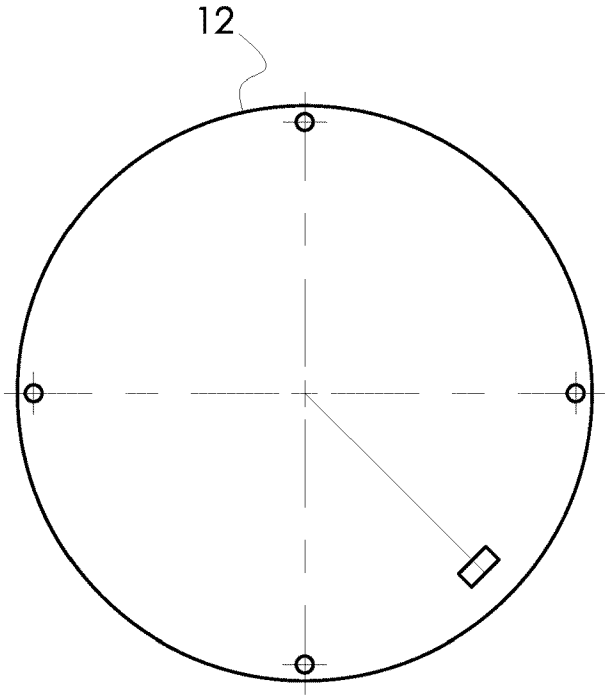
Figure 6B:
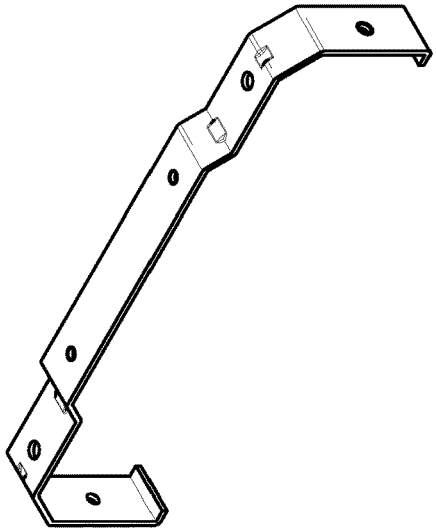
FIGS. 6(*a*)-6(*e*) are several views of the LED driver mounting bracket.
Figure 6E:
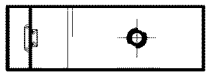
Figure 6A:
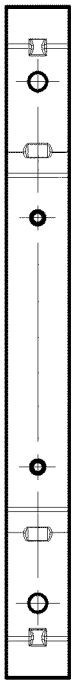
Figure 6D:
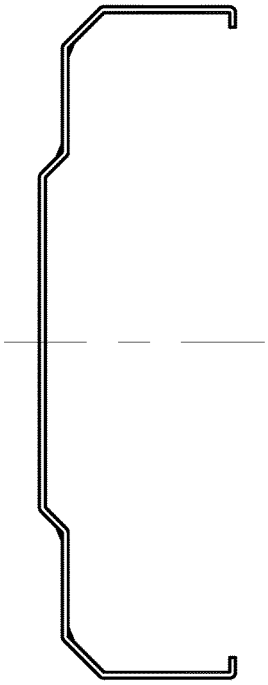
Figure 6C:
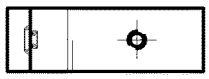
Figure 7C:
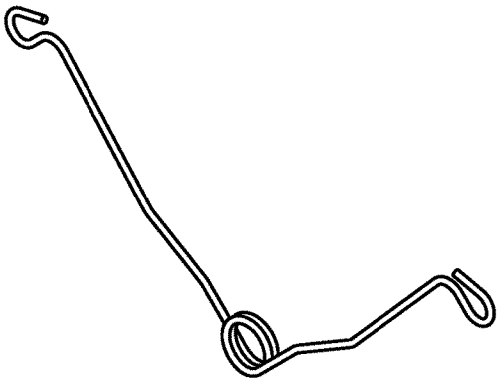
FIGS. 7(*a*)-7(*c*) are several views of the V-torsion spring clip used to mount the light fixture inside of a standard housing, can, or enclosure.
Figure 7B:
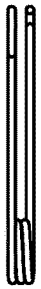
Figure 7A:
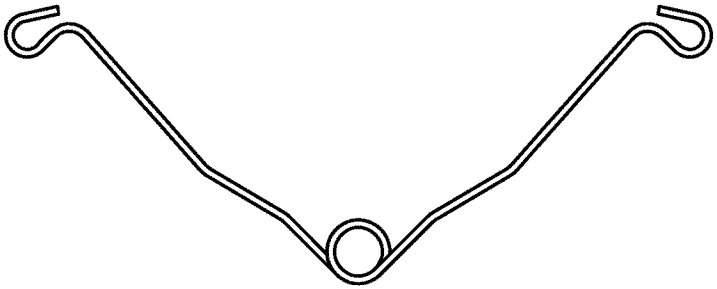
Figure 8B:
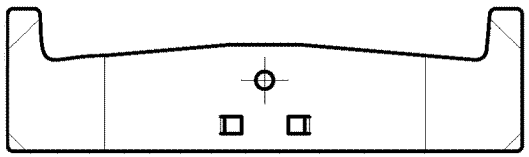
FIGS. 8(*a*)-(*e*) are several views of the friction blade.
Figure 8E:
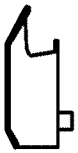
Figure 8A:
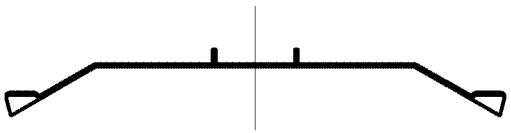
Figure 8D:
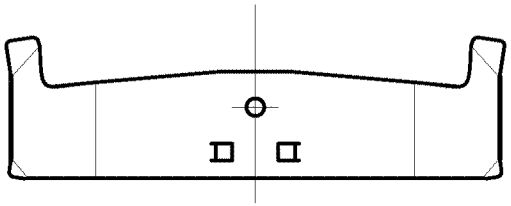
Figure 8C:
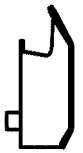
Figures 9A, 9B:
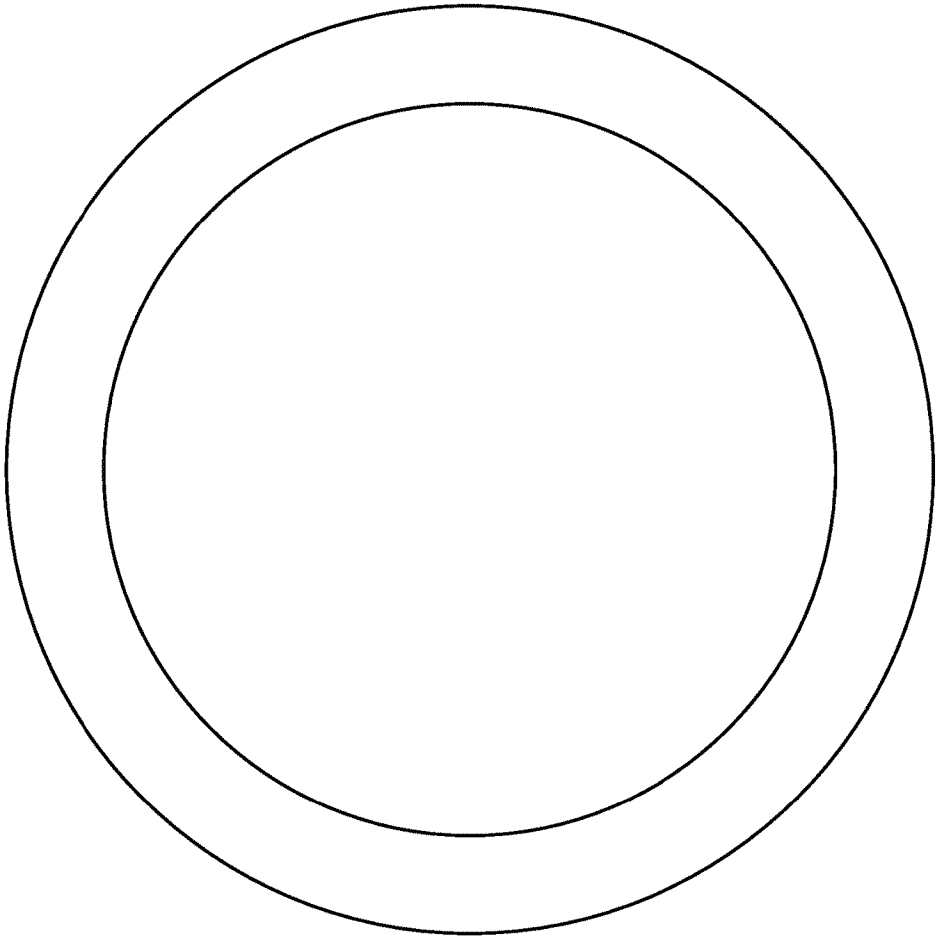
FIGS. 9(*a*) and 9(*b*) are two views of a gasket optionally fitted to the flange lip around the reflector trim shown in drawing FIG. 2. The gasket helps thermally insulate and isolate the living area beneath the ceiling from the space above the ceiling.
Figure 10A:
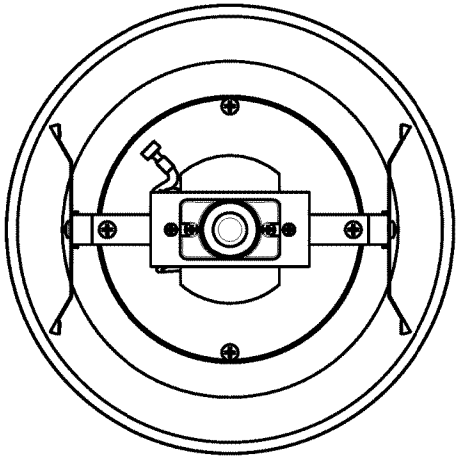
FIGS. 10(*a*)-10(*e*) show a third embodiment of the present invention recessed LED light fixture, including a top plan view, a perspective view, a side elevational view, a cross-sectional view B-B, and an exploded view. This embodiment includes a fixed, standard Edison screw plug at the top to engage a preexisting Edison socket for retrofitting an existing recessed light fixture. Friction blades are mounted to opposite sides of the driver mounting bracket and used to install the light fixture inside a pre-existing housing, can, pan, or enclosure.
Figure 10B:
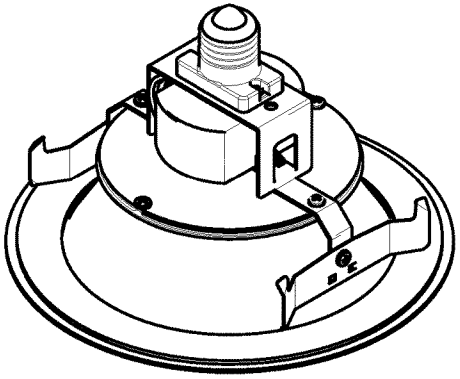
Figure 10C:
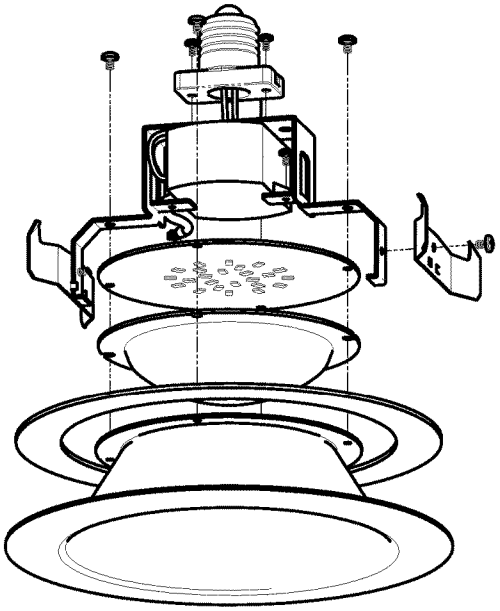
Figure 10D:
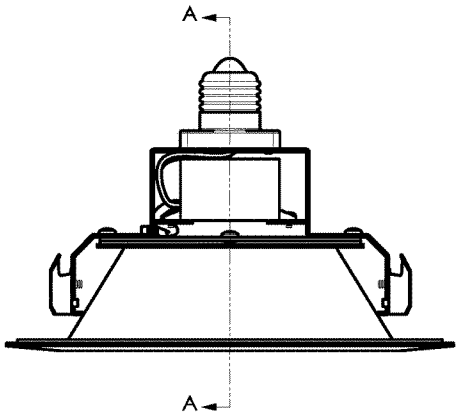
Figure 10E:
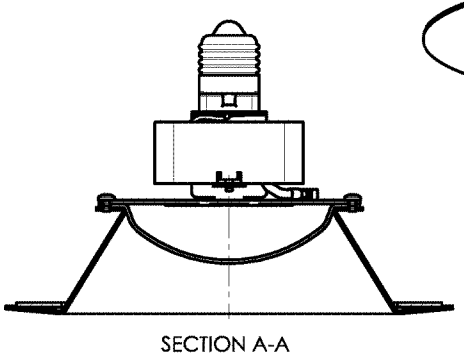
Figures 11A, 11B, 11C, 11D, 11E:
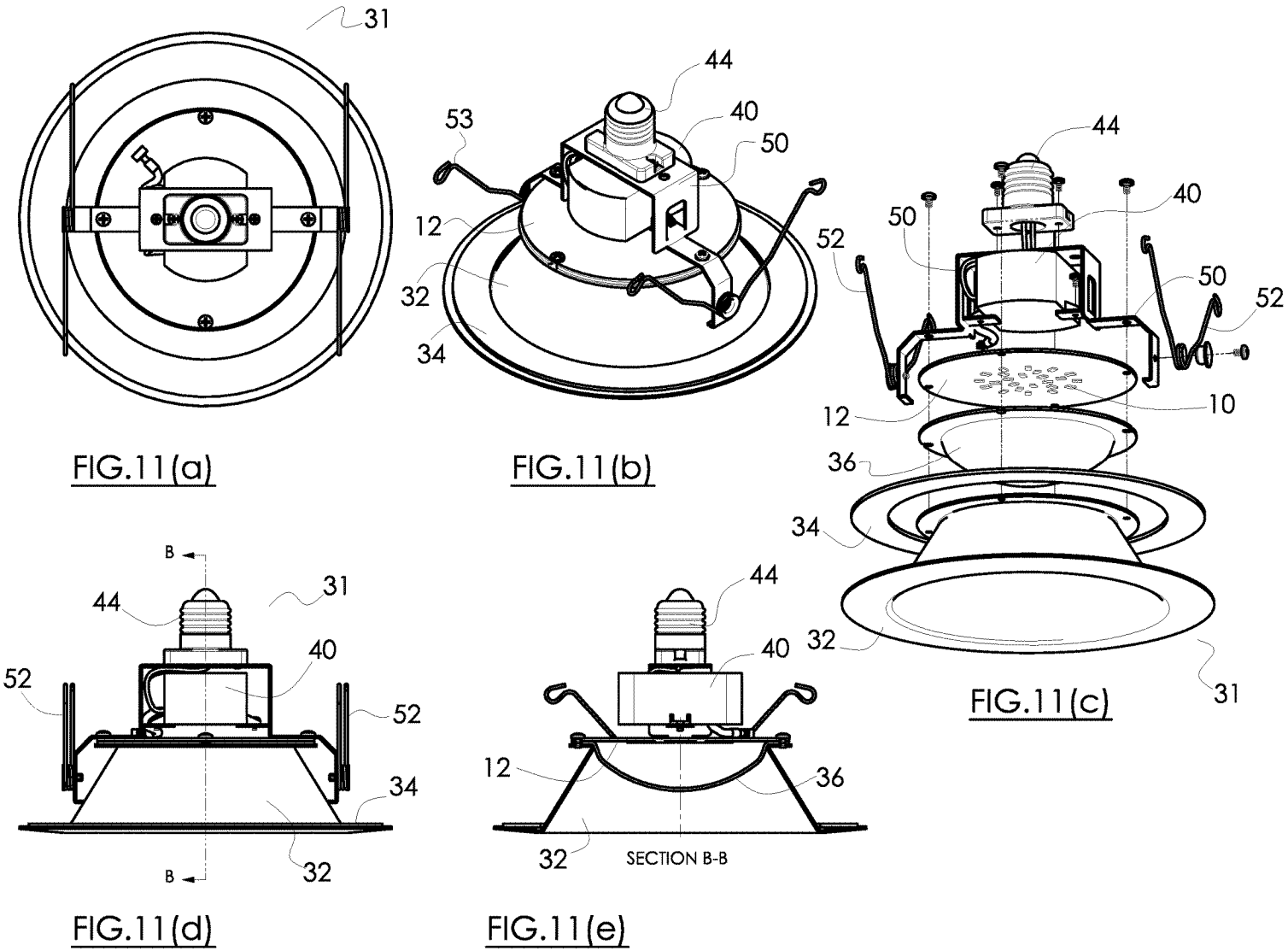
FIGS. 11(*a*)-11(*e*) show a fourth embodiment, which is the third embodiment of FIG. 10 but using V-torsion spring clips instead of the friction blades.
Figure 12:
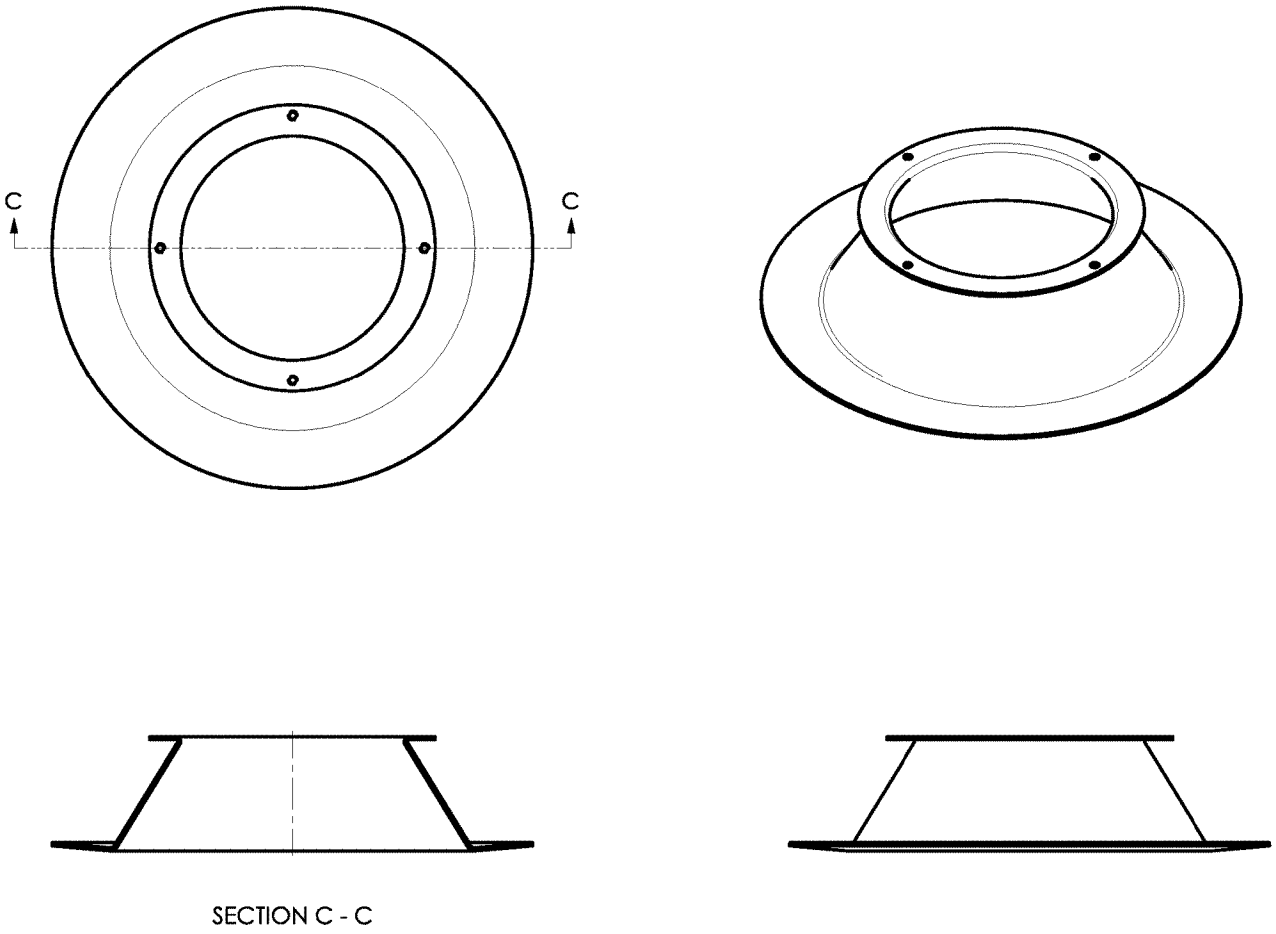
FIG. 12 contains several views of the cone-shaped reflector trim used in the FIGS. 10 and 11 embodiments including a cross-sectional view taken along line C-C.
Figure 13:
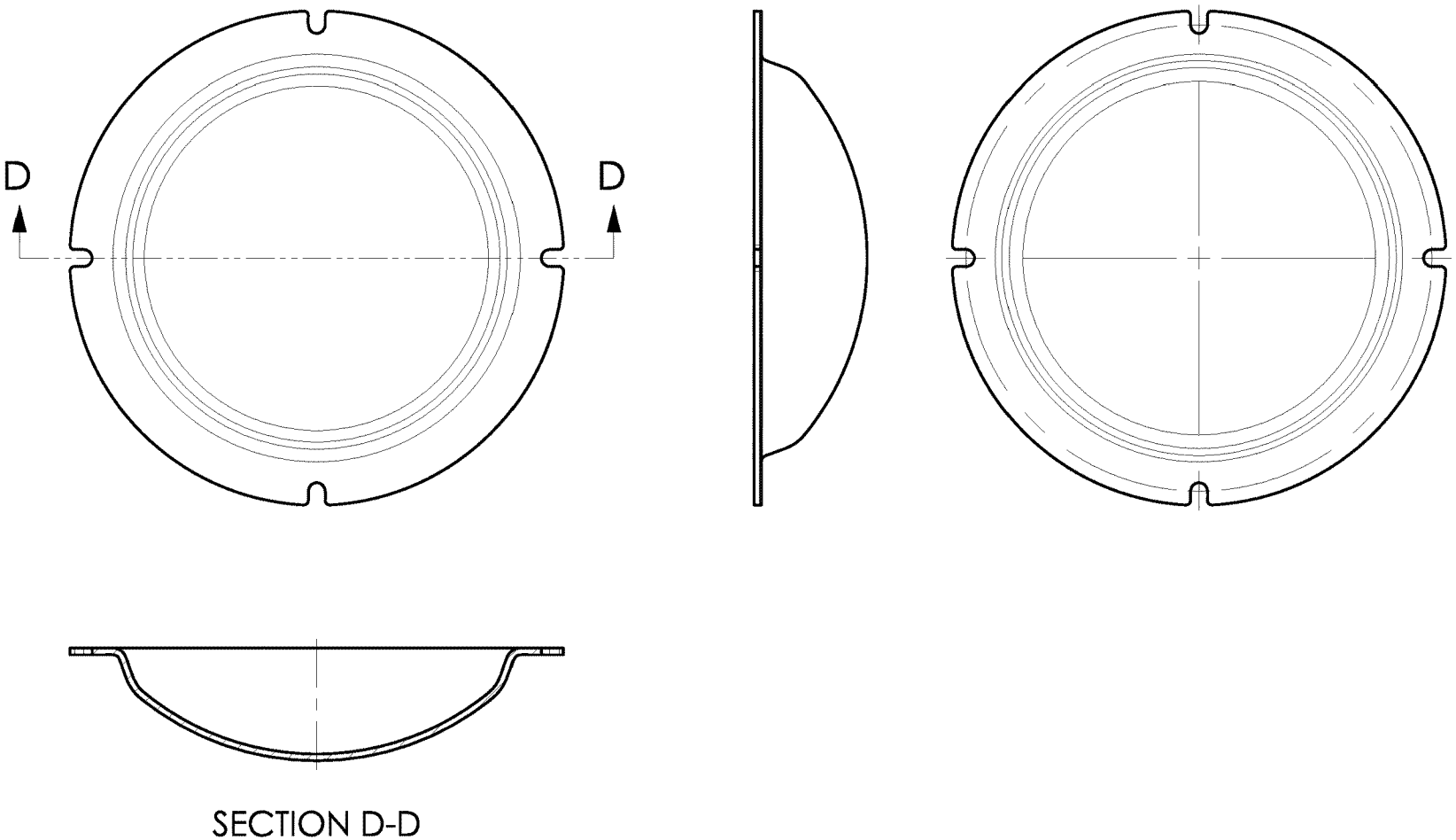
FIG. 13 contains several views of the optional domed lens or light diffuser used in the FIGS. 10 and 11 embodiments including a cross-sectional view taken along line D-D. The lens may be transparent, translucent, textured, and/or includes surface contours.

The preferred embodiment PCB 12 is mounted in a light fixture shown in FIGS. 1 and 11. The FIG. 1 LED light fixture has a quick connect that optionally fits to [a] an Edison plug, or [b] a current day junction box quick connect. The FIG. 11 embodiment simply has an Edison plug that screws into the existing Edison socket of a conventional recessed lighting fixture using standard incandescent bulbs, halogen bulbs, or CFL compact fluorescent bulb and would replace these light sources.

FIG. 1(*c*) is an exploded view of a preferred embodiment LED recessed light fixture 30, for fitment in a standard recessed light fixture can, enclosure, housing, or like building or dwelling framework. The building or dwelling framework is a residential home or commercial building having a ceiling space, a drop down ceiling, wall space, lamp post, floor lamp, or any kind of construction space or support for mounting a light fixture. The LED light fixture 30 includes a preferably cone-shaped reflector trim 32, an optional insulating gasket 34, a domed diffuser/lens 36, all of which are held together by a bracket 38.

The reflector trim 32 is preferably made in a light reflective color or painted or coated with such color to direct the LED light downward toward the living space below. The reflector trim has a circular shaped top, and as seen in FIGS. 1(*b*) and 1(*e*), has a diameter that is smaller than the outside diameter of the PCB 12. Indeed, the outer periphery of the PCB 12 overhangs the reflector trim 32 beneath it. The PCB 12 thus has an oversized diameter and its associated surface area is likewise enlarged; this helps achieve better radiation and convective cooling of the LEDs 10 mounted thereto.

Mounted underneath the bracket 38 is the PCB 12 with its downward facing LED array 10. There can be a single LED or a plurality of LEDs preferably arranged in a cluster. The LED or LEDs may be packaged into a plastic housing with electrical connections, or may be a simple LED die.

Placed atop the bracket 38 is the LED driver 40 with its electrical connection, and in this embodiment, terminating in a quick connect 42. The complementary half of the quick connect 42 is connected to an Edison plug 44. Optional attachment means in the form of friction blades 46 are affixed to the bracket 38. The friction blades 46 are compliant and push against the inside of the pre-existing can, pan, housing, enclosure or building framework (not shown) to stabilize and hold the light fixture 10 therein.

In various alternative embodiments, as seen in FIG. 1(*c*), the light fixture 30 may include a receiving/sending module 60 mounted on the fixture for communication with a wireless control for remote control of the fixture. The antenna 62 for the wireless interface is integral with the reflector trim 32. Electronics for such wireless remote controls are well known in the art as a means for wirelessly controlling the light fixture, such as from a smartphone or remote control, especially for controlling ceiling fans, for example. The receiving/sending module may transmit a signal for Near Field Communication (NFC) to transfer information between devices when they are in contact.

FIG. 11(*c*) is an exploded view of another preferred embodiment LED recessed light fixture 31 with a fixed Edison plug, for fitment in a standard recessed light fixture can. The fixture 31 includes a reflector cone 32, an optional insulating gasket 34, a dome shaped diffuser or lens 36, all of which are held together by a bracket 50. Mounted underneath the bracket 50 is the PCB 12 with its downward facing LED array 10. Also attached to the bracket 50 is the LED driver 40 electrically wired to an Edison plug 44. Optional attachment means in the form of V-torsion spring clips 52 are affixed on opposite sides of the bracket 50. The biased legs of the V-torsion spring clips 52 can be finger pinched against the bias and passed through slots in the can, pan, or fixture enclosure, where they pop open to hold and support the weight of the entire assembly 31 in place inside the can. Other attachment means are contemplated, including twist locks, screws, bolts, springs with hooked ends, flip locks, latches, etc.

As seen in drawing FIGS. 1(*d*) and 11(*d*), there is an optional space above the PCB 12 created by the shaped of the mounting bracket 38, 50. The LED driver 40 with its electronics and power supply attaches to the driver mounting bracket 38, 50 and is thus preferably spaced apart from the hot PCB/LEDs 12, 10. This is best seen in the cross-sectional views A-A and B-B of FIGS. 1 and 11, respectively.

Further, in FIGS. 1(*b*) and 11(*b*), it can be seen that the entire top side of the PCB 12 is exposed to the ambient environment, because no portion is covered by the LED driver 40 by having it mounted directly to the PCB 12. This allows great surface area of the hot PCB 12 to radiate heat into the environment along with cooling from convection currents of the surrounding air.

Indeed, this optional gap enables thermal convection that helps cool the LEDs 10 and the PCB 12. In addition, the driver bracket 38, 50 itself may act as a thermal conductor and heat dissipater. In conventional recessed LED light fixtures, this space between the driver and the PCB is normally occupied by a large, finned, metal heat sink, which is missing here. The present invention thus does not require this bulky secondary (or tertiary, etc.) heat sink to operate efficiently within its design parameters. The bulk, weight, material, manufacturing, labor costs, etc. associated with the secondary heat sink are thus eliminated by the present invention design.

Another embodiment includes a medium based screw-in Edison or like adaptor to allow the assembly to be electrically connected to a light fixture containing a medium base lamp holder, lamp post or similar type socket.

As seen in the FIGS. 1-18, the preferred embodiments provide an LED assembly consisting of a printed circuit board, LEDs, a lens for optical uniformity (not required but helpful) and a reflector cone (may be made from thermally insulating materials or thermally conductive materials) for shielding the LEDs from occupants in the room and distributing the light within the needed space, and brackets which hold an LED driver and the means to mount the assembly within an enclosure. The lens, in this assembly, has also been used to thermally isolate the printed circuit board assembly from the reflector cone. If the lens were not present, a spacer may be used to maintain this spacing. The present invention light fixture is different because it does not require contact with the ambient environment of the room below the enclosure or require a secondary heat sink to manage the thermal characteristics of the LED assembly. All conventional assemblies of this nature have required an additional heat sink coupled to the LED assembly to maintain the thermal stability of their designs.

In an alternative embodiment, the LEDs are directly bonded to the PCB substrate without the traditional thermoplastic housing, wire bonds, and reflow process.

A further alternative embodiment combines the LED driver components directly on the printed circuit board, around the perimeter with selective areas for the driver components. This embodiment eliminates the external driver and reduces the number of components needed for the final assembly and the overall height. Such a compact fixture is versatile in that it can be mounted inside a tight ceiling space or for retrofitting a conventional recessed light fixture that has a small can, for example.

The end benefits to the consumer are lower costs, better shielding angles, because the LED assembly can be taller since the large, secondary heat sink has been eliminated. Further, a more durable and light efficient reflector cone can be selected because material choices are now more flexible to deliver the best mechanical features rather than focusing on thermal conductivity of such components.

While particular forms of the invention have been illustrated and described, it will be apparent that various modifications can be made without departing from the spirit and scope of the invention. It is contemplated that components from one embodiment may be combined with components from another embodiment.

The invention claimed is:

1. An LED light fixture without a metal, finned heat sink for mounting to a building framework, comprising:

at least one LED;

a thermally conductive printed circuit board, wherein the at least one LED is mounted toward the center of the printed circuit board wherein the at least one LED is connected by paths of electrical and thermal conductor material, the printed circuit board having an annular surface area around the edge;

a reflector trim having an open top, wherein the printed circuit board is mounted to the open top and part of the annular surface area is at least one of coupled to and in close proximity to the reflector trim, wherein the reflector trim includes a thermally conductive material, the reflector trim having an annular flange around the open top to engage the printed circuit board at the annular surface area, and wherein the printed circuit board is spaced at a minimum about 3 mm from the reflector trim;

a LED driver for powering the at least one LED, wherein the LED driver is disposed directly on the printed circuit board; and attachment means for mounting the light fixture to the building framework.

2. The LED light fixture of claim 1, wherein the LED driver is mounted on the same side of the printed circuit board as the at least one LED.

3. The LED light fixture of claim 1, wherein the reflector trim includes an alternative low thermal conductivity material having a thermal conductivity of about 0.2 W/m-K.

4. The LED light fixture of claim 1, wherein the fixture includes a receiving/sending module mounted on the fixture for communication with a wireless control.

5. The LED light fixture of claim 4, wherein an antenna for the wireless control is mounted and connected to send and receive signals through the reflector trim.

6. The LED light fixture of claim 4, wherein the receiving/sending module sends and receives Near Field Communication signals.

7. The LED light fixture of claim 1, wherein the fixture includes a diffuser covering the packaged LED and the diffuser is spaced apart from the reflector trim.

8. The LED light fixture of claim 1, wherein the thermally conductive printed circuit board includes a Metal Core Printed Circuit Board (MCPCB) having a thermally conductive metallic core.

9. The LED light fixture of claim 1, wherein the printed circuit board includes a thermal conductive material on a surface engaging the reflector trim.

10. An LED light fixture without a metal, finned heat sink, comprising:

at least one LED;

a thermally conductive Metal Core Printed Circuit Board (MCPCB) having a first diameter, wherein the at least one LED is mounted toward the center of the MCPCB, and wherein the at least one LED is connected by paths of electrical and thermal conductor material, and the MCPCB includes an annular surface area;

a reflector trim having an open top, wherein the MCPCB is mounted to the open top and part of the annular surface area is at least one of coupled to and in close proximity to the reflector trim, wherein the reflector trim includes a thermally conductive material, the reflector trim having an annular flange around the open top to engage the MCPCB at the annular surface area, and wherein the MCPCB is spaced at a minimum about 3 mm from the reflector trim;

a LED driver having components for powering the at least one LED, wherein the LED driver components are disposed directly on the MCPCB and coplanar with the at least one LED;

a mounting system spacing the LED driver away from the MCPCB creating an air gap therebetween; and attachment means for mounting the light fixture.

11. The LED light fixture of claim 10, wherein the attachment means includes at least one of friction blades and V-torsion spring clips.

12. The LED light fixture of claim 10, wherein the reflector trim includes a cone shape, an open top, and an upper lip that engages the MCPCB.

13. The LED light fixture of claim 10, wherein the MCPCB has a circular shape with a first diameter, and the reflector trim has a circular top with a second diameter, and the first diameter is larger than the second diameter.

14. The LED light fixture of claim 10, wherein the at least one LED further comprises a plurality of LEDs clustered together at a center of the MCPCB without any LEDs at the outer periphery.

15. The LED light fixture of claim 10, wherein the MCPCB includes open surface areas covered by sections of an electrical and thermal conductor material.

16. An LED light fixture without a metal, finned heat sink, comprising:

a plurality of LEDs;

a thermally conductive Metal Core Printed Circuit Board (MCPCB) having a first outside diameter, wherein the plurality of LEDs are mounted toward the center of the MCPCB in a plane, and wherein the plurality of LEDs are connected by paths of electrical and thermal conductor material, and wherein the MCPCB includes an annular surface area proximate to the first outside diameter;

a reflector trim having an open top, wherein the MCPCB is mounted to the open top and part of the annular surface area is at least one of coupled to and in close proximity to the reflector trim, wherein the reflector trim includes a thermally conductive material, the reflector trim having an annular flange around the open top to engage the MCPCB at the annular surface area, and wherein the MCPCB is spaced at a minimum about 3 mm from the reflector trim;

a LED driver consisting of components for powering the plurality of LEDs, wherein the LED driver components are disposed on the MCPCB;

a diffuser covering the plurality of LEDs;

a mounting system spacing the LED driver away from the MCPCB creating an air gap therebetween; and attachment means for mounting the light fixture.

17. The LED light fixture of claim 16, wherein the diffuser is spaced apart from the MCPCB by a gap.

18. The LED light fixture of claim 16, wherein the MCPCB include a thermally conductive metallic core.

19. The LED light fixture of claim 16, wherein the reflector trim includes a material with a thermal conductivity of about 2 W/m-K to about 49 W/m-K.

20. The LED light fixture of claim 16, wherein the LED driver components are disposed on the MCPCB coplanar with the plane containing the plurality of LEDs.

* * * * *